US006617801B2

(12) United States Patent
Ishizuka et al.

(10) Patent No.: US 6,617,801 B2
(45) Date of Patent: Sep. 9, 2003

(54) DRIVE DEVICE FOR A LIGHT-EMITTING PANEL, AND A PORTABLE TERMINAL DEVICE INCLUDING A LIGHT-EMITTING PANEL

(75) Inventors: Shinichi Ishizuka, Tsurugashima (JP); Hideo Ochi, Tsurugashima (JP); Masaki Murakata, Yonezawa (JP); Takayoshi Yoshida, Yonezawa (JP)

(73) Assignees: Pioneer Corporation, Tokyo (JP); Tohoku Pioneer Corporation, Yamagata-ken (JP)

( * ) Notice: Subject to any disclaimer, the term of this patent is extended or adjusted under 35 U.S.C. 154(b) by 0 days.

(21) Appl. No.: 10/152,812

(22) Filed: May 23, 2002

(65) Prior Publication Data

US 2002/0175634 A1 Nov. 28, 2002

(30) Foreign Application Priority Data

May 28, 2001 (JP) ..... 2001-159425

(51) Int. Cl.[7] ..... G09G 3/10

(52) U.S. Cl. ..... 315/169.3; 315/169.1; 345/55; 345/77

(58) Field of Search ..... 315/169.1, 169.2, 315/169.3, 169.4, 291; 345/76, 77, 34, 35, 36, 45, 46, 82, 55

(56) References Cited

U.S. PATENT DOCUMENTS 5,793,163 A * 8/1998 Okuda ..... 315/169.2
6,351,076 B1 * 2/2002 Yoshida et al. ..... 315/169.1
6,473,064 B1 * 10/2002 Tsuchida et al. ..... 345/82
6,496,168 B1 * 12/2002 Tomida ..... 345/76

* cited by examiner

*Primary Examiner*—Hoang Nguyen
(74) *Attorney, Agent, or Firm*—Sughrue Mion, PLLC

(57) ABSTRACT

A drive device for a light-emitting panel that is capable of adjusting the anode power source voltage to be applied to anode leads of the light-emitting panel to a suitable voltage value with low power consumption and in a reliable fashion. A prescribed anode lead of the anode leads of the light-emitting panel is designated as the anode lead that is to be the subject of detection. The voltage value on this anode lead which is the subject of detection is input as the forward voltage value only while display is being performed in accordance with prescribed information data to cause drive current to be supplied to at least the anode lead that is the subject of detection, and the anode power source voltage is adjusted in accordance with this forward voltage value.

12 Claims, 10 Drawing Sheets

FIG.12

| $GP_1$ | $GP_2$ | $GP_3$ | $GP_4$ | $GP_5$ | --- | $GP_{m-2}$ | $GP_{m-1}$ | $GP_m$ | $SW_1$ | $SW_2$ | $SW_3$ | $SW_4$ | $SW_5$ | --- | $SW_{m-2}$ | $SW_{m-1}$ | $SW_m$ |
|---|---|---|---|---|---|---|---|---|---|---|---|---|---|---|---|---|---|
| 1 | X | X | X | X | --- | X | X | X | 1 | 0 | 0 | 0 | 0 | --- | 0 | 0 | 0 |
| 0 | 1 | X | X | X | --- | X | X | X | 0 | 1 | 0 | 0 | 0 | --- | 0 | 0 | 0 |
| 0 | 0 | 1 | X | X | --- | X | X | X | 0 | 0 | 1 | 0 | 0 | --- | 0 | 0 | 0 |
| 0 | 0 | 0 | 1 | X | --- | X | X | X | 0 | 0 | 0 | 1 | 0 | --- | 0 | 0 | 0 |
| 0 | 0 | 0 | 0 | 1 | --- | X | X | X | 0 | 0 | 0 | 0 | 1 | --- | 0 | 0 | 0 |
| ⋮ | ⋮ | ⋮ | ⋮ | ⋮ | | ⋮ | ⋮ | ⋮ | ⋮ | ⋮ | ⋮ | ⋮ | ⋮ | | ⋮ | ⋮ | ⋮ |
| 0 | 0 | 0 | 0 | 0 | --- | 1 | X | X | 0 | 0 | 0 | 0 | 0 | --- | 1 | 0 | 0 |
| 0 | 0 | 0 | 0 | 0 | --- | 0 | 1 | X | 0 | 0 | 0 | 0 | 0 | --- | 0 | 1 | 0 |
| 0 | 0 | 0 | 0 | 0 | --- | 0 | 0 | 1 | 0 | 0 | 0 | 0 | 0 | --- | 0 | 0 | 1 |
| 0 | 0 | 0 | 0 | 0 | --- | 0 | 0 | 0 | 0 | 0 | 0 | 0 | 0 | --- | 0 | 0 | 0 |

X = "1" OR "0"

DRIVE DEVICE FOR A LIGHT-EMITTING PANEL, AND A PORTABLE TERMINAL DEVICE INCLUDING A LIGHT-EMITTING PANEL

BACKGROUND OF THE INVENTION

1. Field of the Invention

The present invention relates to a drive device that performs light-emitting drive of a light-emitting panel wherein capacitative light-emitting elements such as organic electroluminescent elements are arranged in matrix fashion.

2. Description of the Related Art

In recent years, as display devices have become of large size, thin display devices are being demanded and various types of thin display devices are being put into practice. Organic electroluminescent elements (hereinbelow simply referred to as EL elements) are known as one type of display element employed in such thin display devices.

EL elements are capacitative light-emitting elements that may in electrical terms be equivalently represented by a capacitative constituent C and a diode-characteristic constituent coupled in parallel with this capacitative constituent, as shown in FIG. 1. When a DC light-emitting drive voltage is applied between the electrodes of the EL element, electrical charge is accumulated on capacitative constituent C and when the barrier voltage or light-emitting threshold voltage that is characteristic of this element is exceeded current starts to flow from the electrode (anode side of the diode constituent E) to the organic functional layer that performs the role of light-emitting layer, thereby causing this to emit light with an intensity proportion to this current.

FIG. 2 of the accompanying drawings is a view showing the voltage V-current I-brightness L characteristic of such an EL element.

As shown in FIG. 2, the characteristic of an EL element is similar to that of a diode; at voltages below the light-emitting threshold voltage $V_{th}$, the current I is very small while at voltages at or above the light-emitting threshold value $V_{th}$ the current increases abruptly. Also, the brightness L is practically proportional to the current I. That is, if a drive voltage exceeding the light-emitting threshold value voltage $V_{th}$ is applied, a light-emitting brightness proportional to the current produced by this drive voltage is presented while if the drive voltage is below the light-emitting threshold voltage $V_{th}$ no drive current flows and the light-emitting brightness remains at zero.

FIG. 3 of the accompanying drawings diagrammatically illustrates the construction of an EL display device in which is mounted a light-emitting panel constituted by a matrix arrangement of such EL elements.

In FIG. 3, n cathode leads (metallic electrodes) $B_1$ to $B_n$ are arranged in parallel in the horizontal direction in light-emitting panel 11 while m anode leads (transparent electrodes) $A_1$, to $A_m$, are arranged in parallel in the vertical direction, respectively, EL elements $E_{1,1}$ to $E_{m,n}$ being formed at the intersections (total of n×m intersections). The EL elements $E_{1,1}$ to $E_{m,n}$ that play the role of pixels are arranged in lattice fashion, corresponding to the positions of intersections of anode leads $A_1$ to $A_m$ along the vertical direction and cathode leads $B_1$ to $B_n$ along the horizontal direction, with one terminal thereof being connected to the anode lead (anode lead side of diode constituent E of the above equivalent circuit) and their other terminals (cathode lead side of diode constituent E of the above equivalent circuit) being connected with the cathode leads.

Light emission control circuit 12 respectively controls cathode lead scanning circuit 13 and anode lead driver 14 such that an image representing the video data is caused to be displayed in accordance with this input video data. Specifically, light emission control circuit 12 supplies to cathode lead scanning circuit 13 scanning pulse signal SP such as to make the respective EL elements $E_{1,1}$ to $E_{m,n}$ capable of being driven, one horizontal scanning line at a time. Furthermore, light emission control circuit 12 generates drive pulses having a logic level corresponding to the input video data and supplies these drive pulses to anode lead driver 14, one horizontal scanning line ($GP_1$ to $GP_m$) at a time. Cathode lead scanning circuit 13 includes scanning switches $\mathbf{5}_1$ to $\mathbf{5}_n$ corresponding to the cathode leads $B_1$ to $B_n$ that individually determine the voltages of the cathode leads. Scanning switches $\mathbf{5}_1$ to $\mathbf{5}_n$ respectively apply earth potential (0 V) to the corresponding cathode lead during the period in which scanning pulse signal SP is applied from light emission control circuit 12 and in periods other than this apply bias potential Vcc (for example 10 V) thereto. The bias potential Vcc is applied in order to prevent crosstalk light emission by EL elements respectively connected to respective cathode leads to which scanning pulse signal SP is not supplied and is normally set at bias potential $Vcc=V_F$ Anode power source circuit 10 generates a prescribed anode power source voltage $V_A$ constituting the source of drive current supplied to respective anode leads $A_1$ to $A_m$ in order to drive respective EL elements $E_{1,1}$ to $E_{m,n}$ in accordance with the power source voltage from battery 100; this is then supplied to anode lead driver 14. Anode lead driver 14 comprises anode drive switches $\mathbf{6}_1$ to $\mathbf{6}_m$ and constant current drivers $\mathbf{2}_1$ to $\mathbf{2}_m$ constituting current sources that supply drive current respectively to the EL elements $E_{1,1}$ to $E_{m,n}$ through anode leads $A_1$ to $A_m$ respectively, of light-emitting panel 11. Constant current drivers $\mathbf{2}_1$ to $\mathbf{2}_m$ respectively generate the above drive currents having a prescribed constant current in accordance with anode power source voltage $V_A$ supplied from anode power source circuit 10 and output these respectively to anode drive switches $\mathbf{6}_1$ to $\mathbf{6}_m$. Anode drive switches 6 connect the output terminal of constant current drivers 2 to anode leads A if the drive pulse GP supplied from light emission control circuit 12 is for example logic level "1" and apply earth potential to the anode leads A if the drive pulse GP is logic level "0". For example, anode drive switch $\mathbf{6}_1$ connects the output terminal of constant current driver $\mathbf{2}_1$ to anode lead $A_1$ if the drive pulse $GP_1$ supplied from light emission control circuit 12 is for example logic level "1" and applies earth potential to the anode lead $A_1$ if the drive pulse $GP_1$ is logic level "0". Also, anode drive switch $\mathbf{6}_m$ connects the output terminal of constant current driver $\mathbf{2}_m$ to anode lead $A_m$ if the drive pulse $GP_m$ supplied from light emission control circuit 12 is for example logic level "1" and applies earth potential to the anode lead $A_m$ if the drive pulse $GP_m$ is logic level "0". The amounts of current supplied by the respective constant current drivers $\mathbf{2}_1$ to $\mathbf{2}_m$ are the current amounts necessary to maintain a condition in which an EL element is emitting light with the desired instantaneous brightness (hereinbelow, this condition is called the "steady light emission condition"). Also, when an EL element is in the steady light emission condition, charge is stored on the capacitative constituent C of this EL element, so the voltage across the two terminals of the EL element is a positive voltage $V_F$ somewhat higher than the light-emitting threshold voltage $V_{th}$ (this voltage is called the forward voltage). Consequently, only the EL elements on the cathode lead that is set to earth potential in response to the scanning pulse signal SP emit light in response to the drive current that is supplied from constant current drivers 2. Of the respective anode drive switches $\mathbf{6}_1$ to $\mathbf{6}_m$, only the anode switches that are supplied with drive pulses of logic level "1" from light emission control circuit 12 apply drive current on the corresponding anode lead. The respective EL elements $E_{1,1}$ to $E_{i,j}$ that are provided in light-emitting panel 11 are thereby made to assume a light emission condition (light-emitting or non-light-emitting) in response to the input video (image) data.

The condition of the light-emitting panel 11 shown in FIG. 3 illustrates by way of example a condition in which cathode lead $B_1$ is driven (scanned) and the EL elements $E_{1,1}$ and $E_{2,}1$ connected to this cathode lead $B_1$ are lit. In FIG. 3, EL elements in light-emitting condition are indicated by diode symbols and EL elements in non-light-emitting condition are indicated by capacitor symbols, respectively.

In the condition shown in FIG. 3, cathode electrode lead $B_1$ is driven by only scanning switch $\mathbf{5}_1$ being changed over to the earth potential side 0 V. Bias voltage Vcc is applied by scanning switches $\mathbf{5}_2$ to $\mathbf{5}_n$ to the other cathode leads $B_2$ to $B_n$. Concurrently, drive current from constant current drivers $\mathbf{2}_1$ and $\mathbf{2}_2$ is applied to anode leads $A_1$ and $A_2$ by anode drive switches $\mathbf{6}_1$ and $\mathbf{6}_2$. Consequently, in this case, only EL elements $E_{1,1}$ and $E_{2,1}$ are biased in the forward direction, thereby allowing drive current to flow as shown by the arrows from constant current drivers $\mathbf{2}_1$ and, so that only EL elements $E_{1,1}$ and $E_{2,1}$ are lit.

The relationship between the forward voltage and the drive current applied to the EL elements changes in accordance with the change of temperature as shown in FIG. 4. In addition, as shown in FIG. 5, as is known, this forward voltage rises with lapse of time. In some cases, change of the forward voltage of the EL element with temperature and/or time may make it impossible for constant current drivers 2 to drive the EL element with the prescribed constant current. In this situation, in order to avoid this problem, consideration has been given to supplying anode power source voltage $V_A$ on the high side beforehand to constant current drivers 2, but this leads to the problem that if the power source voltage is made high, power consumption is also increased.

Accordingly, in an EL display device as shown in FIG. 3, the above problem is solved by the provision of an anode voltage detection circuit 15 and forward voltage input circuit 16.

Anode voltage detection circuit 15 detects the voltage on one or other of the anode leads $A_1$ to $A_m$ (anode lead $A_m$ in FIG. 3) and supplies an anode voltage value $V_D$ indicating this voltage value to forward voltage input circuit 16. Forward voltage input circuit 16 inputs as the forward voltage value generated on the anode lead the anode voltage value $V_D$ supplied from anode voltage detection circuit 15, and supplies forward voltage value $V_F$ indicating this to anode power source circuit 10.

Anode power source circuit 10 adjusts the value of the anode power source voltage $V_A$ that is to be supplied to the respective constant current drivers $\mathbf{2}_1$ to $\mathbf{2}_m$ so as to be equal to a voltage value obtained by adding to the above forward voltage value $V_F$ the loss voltage generated in constant current drivers 2. In other words, anode power source circuit 10 performs adjustment such as to lower the anode power source voltage $V_A$ if the voltage value of the anode power source voltage $V_A$ is higher than the voltage value required when the EL elements are maintaining a steady light-emitting condition and such as to raise the anode power source voltage $V_A$ if it is lower than this. By such power source voltage adjustment, even if the forward voltage $V_F$ changes due to the temperature change or change with time of the EL elements, an anode power source voltage can be generated having an optimum voltage value tracking such changes.

However, in order to input the forward voltage generated on the anode lead, it is necessary that drive current should be flowing on this anode lead. Whether or not drive current is flowing on the anode lead depends on the input video data. Accordingly, whether or not drive current is flowing in the anode lead $A_m$ is determined by constantly monitoring whether or not drive pulse $GP_m$ is logic level "1" by forward voltage input circuit 16 shown in FIG. 3. Thus it is arranged that forward voltage input circuit 16 inputs the anode voltage value $V_D$ as forward voltage value $V_F$ only if it is determined that drive pulse $GP_m$ is logic level "1" i.e., if it is determined that drive current is flowing on anode lead $A_m$.

However, with such a construction, the monitoring action as to whether or not drive current is flowing on anode lead Am must be carried out constantly, so there is the problem of considerable wasted power consumption.

In addition, since whether or not drive current is flowing on anode lead $A_m$ depends on the input video data, there is the problem that the nature of the display content could produce an absence of opportunities for drive current to flow on anode lead $A_m$, thereby making it impossible to adjust the anode power source voltage $V_A$.

SUMMARY OF THE INVENTION

An object of the present invention is to provide a drive device for a light-emitting panel whereby the anode power source voltage can be automatically adjusted to an optimum value with low power consumption and in a reliable fashion.

According to one aspect of the present invention, there is provided a drive device suitable for a light-emitting panel that includes a plurality of mutually intersecting anode leads and cathode leads and a plurality of light-emitting elements connected between said anode leads and said cathode leads at the intersections of said anode leads and said cathode leads, in which said respective light-emitting elements in the light-emitting panel are made to selectively emit light in response to information data. The drive device includes: an anode power source circuit that generates anode power source voltage; a current source that generates drive current to cause said light-emitting elements to emit light using said anode power source voltage; an anode drive switch that supplies said drive current selectively to said respective anode leads in response to said information data; an anode voltage detection circuit that designates a prescribed anode lead of said respective anode leads as an anode lead that is the subject of detection and obtains an anode voltage value by detecting a voltage value on this anode lead designated as the subject of detection; a control circuit that supplies to said anode drive switch prescribed information data to cause said drive current to be supplied in respect of at least said anode lead designated as the subject of detection; and a forward voltage input circuit that inputs as forward voltage value said anode voltage value only while said prescribed information data is being supplied to said anode drive switch; in which said anode power source circuit adjusts said anode power source voltage in response to said forward voltage value that is input by said forward voltage input circuit.

The prescribed anode lead in the respective anode leads of the light-emitting panel is designated as the subject of voltage detection. First, image display is performed based on prescribed image data in regard to which drive current is supplied in respect of at least this anode lead that is designated as the subject of voltage detection. Then, it is arranged that the voltage value on this anode lead that has been thus designated as the subject of detection is input as the forward voltage value, only while this display is being performed, and the anode power source voltage to be applied to the anode lead is adjusted in accordance with this forward voltage value. Consequently, since, while image display in accordance with prescribed image data is being effected as described above, drive current must of necessity be flowing on the anode lead that is the subject of detection, the anode power source voltage can be adjusted to a suitable value in a reliable fashion. Further, since a construction for determining whether or not drive current is flowing on the anode lead that is the subject of detection is unnecessary, the circuit construction can be made of small size, reducing the power consumption.

According to another aspect of the present invention, there is provided a portable terminal device comprising a light-emitting panel. The light-emitting panel includes a plurality of mutually intersecting anode leads and cathode leads and a plurality of light-emitting elements connected between said anode leads and said cathode leads at the intersections of said anode leads and said cathode leads. The portable terminal device comprises: a transmitting/receiving circuit that performs transmission and reception of information data; a battery that generates power source voltage; an anode power source circuit that generates anode power source voltage using said power source voltage; a current source that generates drive current to cause said light-emitting elements to emit light using said anode power source voltage; an anode drive switch that supplies said drive current selectively to said respective anode leads in response to said information data; an anode voltage detection circuit that designates a prescribed anode lead of said respective anode leads as an anode lead that is the subject of detection and obtains an anode voltage value by detecting a voltage value on this anode lead designated as the subject of detection; a control circuit that supplies to said anode drive switch prescribed information data to cause said drive current to be supplied in respect of at least said anode lead designated as the subject of detection; and a forward voltage input circuit that inputs as forward voltage value said anode voltage value only while said prescribed information data is being supplied to said anode drive switch; in which said anode power source circuit adjusts said anode power source voltage in response to said forward voltage value that is input by said forward voltage input circuit.

BRIEF DESCRIPTION OF THE DRAWINGS

FIG. 12 illustrates an example of a signal conversion table employed in a switch changeover signal generating circuit of the EL display device shown in FIG. 11.

DETAILED DESCRIPTION OF THE INVENTION

Embodiments of the present invention will be described in detail below with reference to the accompanying drawings.

Figure 1:
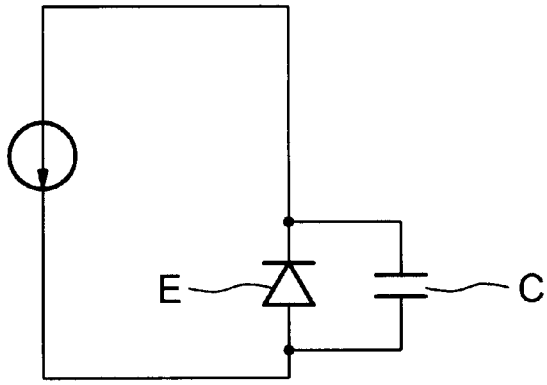
FIG. 1 illustrates an equivalent circuit of an organic electroluminescent element.
Figure 2:
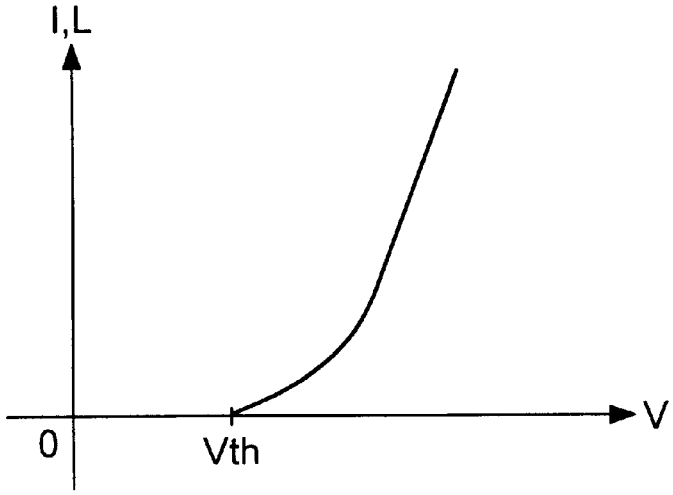
FIG. 2 diagrammatically illustrates the drive voltage-current-light emission brightness characteristic of an organic electroluminescent element.
Figure 3:
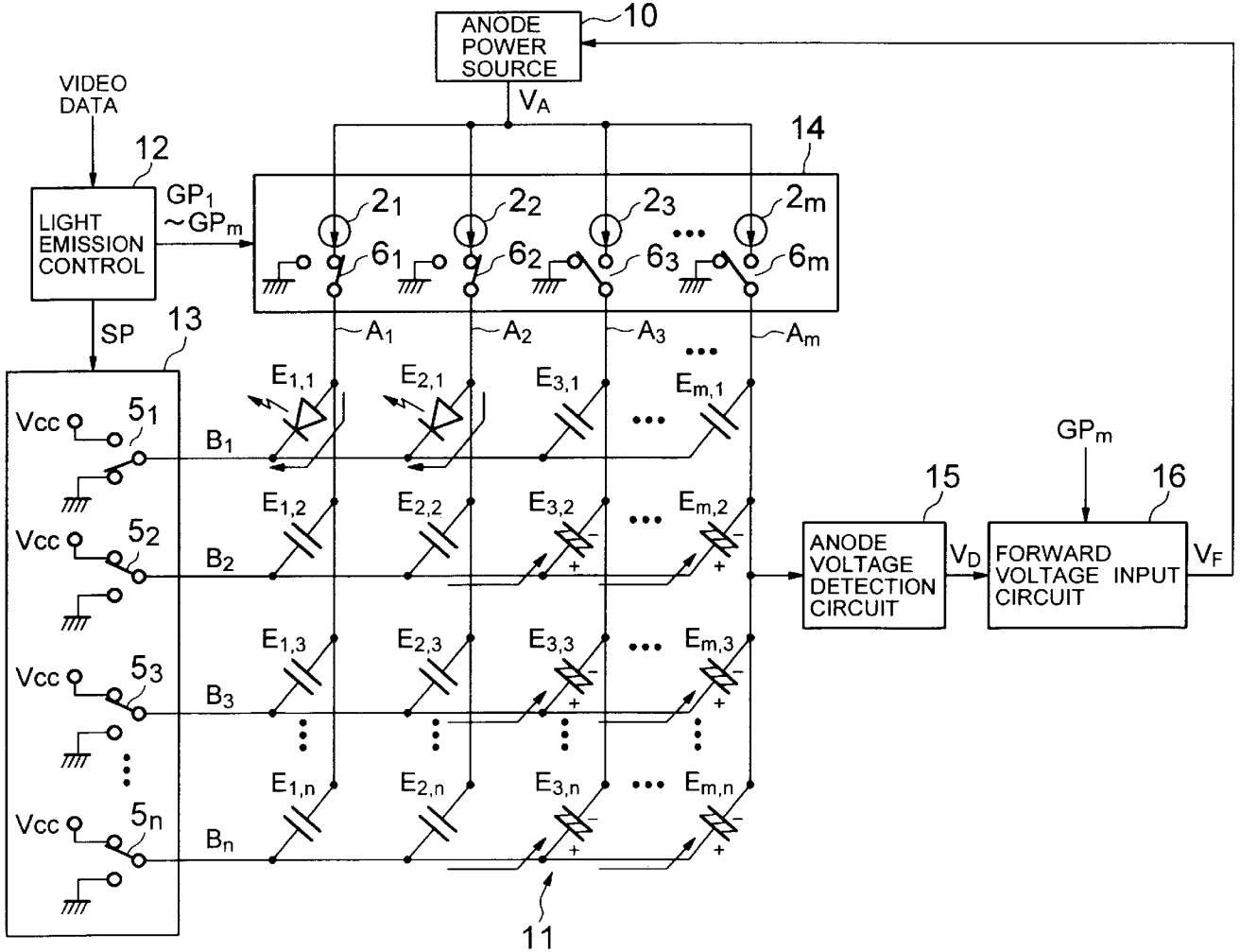
FIG. 3 is a view given in explanation of the diagrammatic layout and operation of an EL display device.
Figure 4:
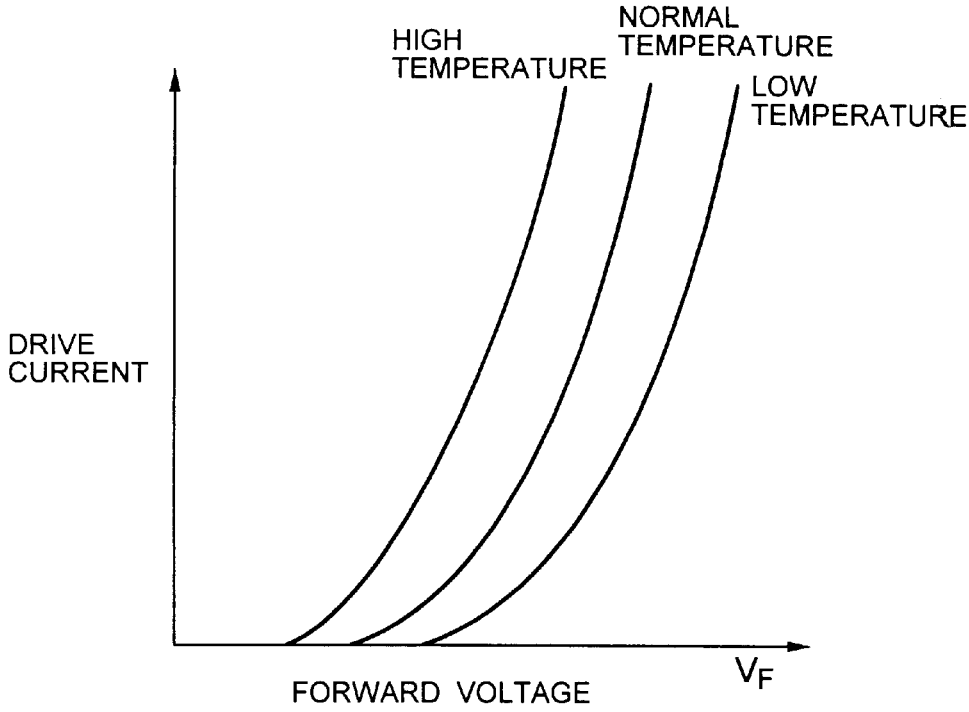
FIG. 4 illustrates the forward voltage $V_F$-drive current characteristic.
Figure 5:
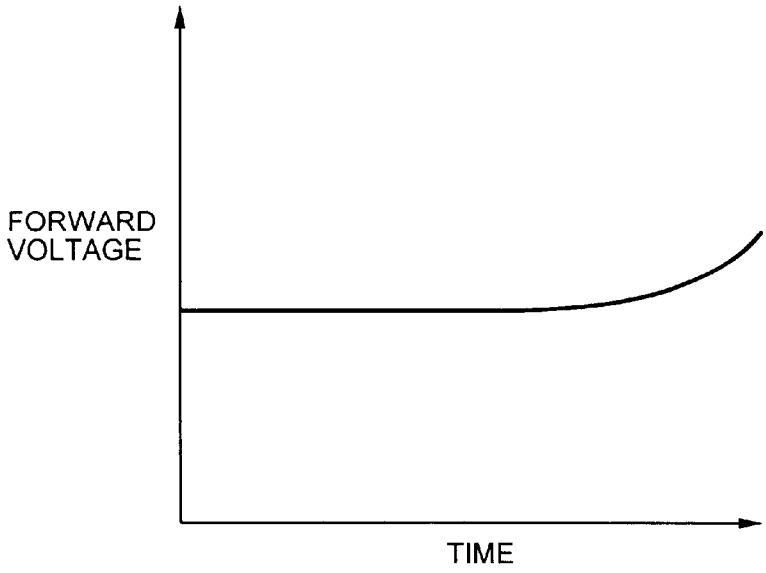
FIG. 5 illustrates the time-forward voltage characteristic.
Figure 6:
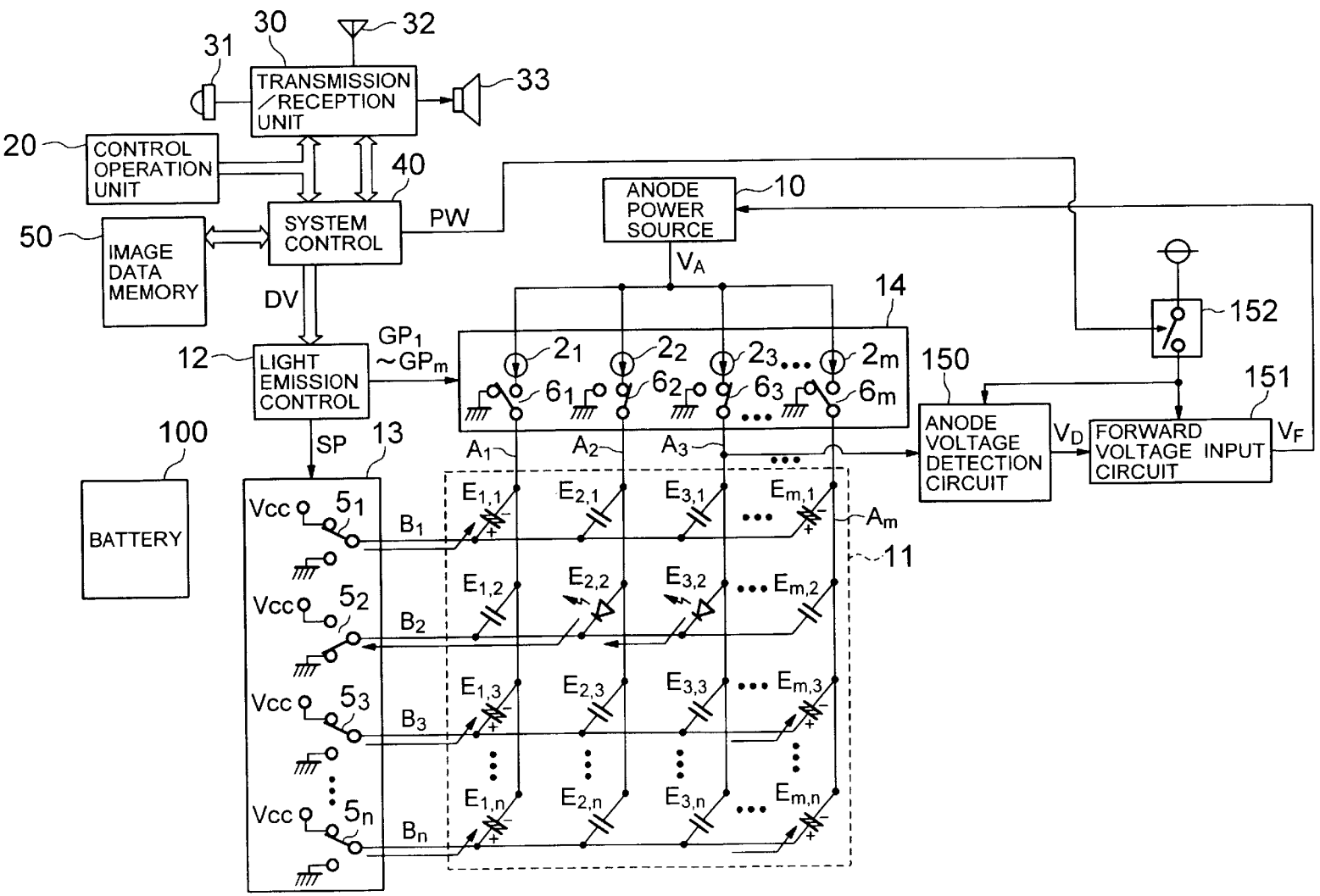
FIG. 6 illustrates the internal construction of a portable terminal on which is mounted an EL display device that is driven for light emission by a drive device according to one embodiment of the present invention.
Figure 7:
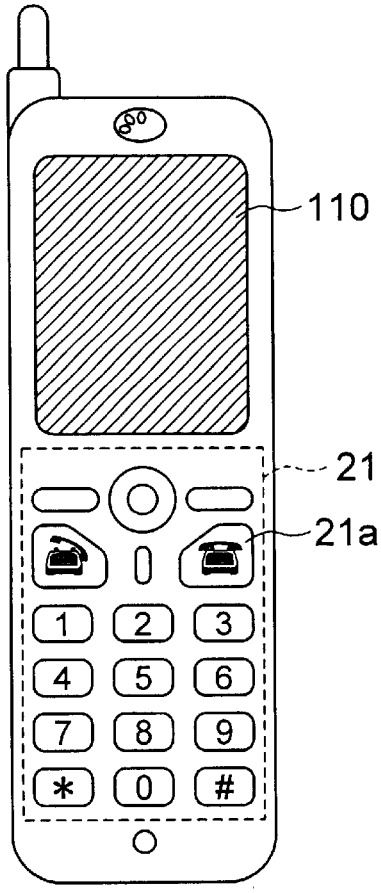
FIG. 7 illustrates an example of the front panel of the portable terminal shown in FIG. 6.

FIG. 6 illustrates the internal construction of a portable terminal, on which is mounted an EL display device that is driven for light emission by a drive device according to the present invention. FIG. 7 illustrates an example of the appearance of such a portable terminal, in particular of its front panel.

In FIG. 6, battery 100 generates various power source voltages to operate various functional modules including light-emitting panel 11. As shown in FIG. 7, control device 20 accepts various control operations from the user, using a group 21 of control buttons provided on the front panel of the portable terminal and thereby supplies various types of control signal or letter data in accordance with such control operation to transmitting/receiving device 30 and system control circuit 40, respectively. Transmitting/receiving device 30 performs prescribed modulation processing on the letter data supplied from control device 20 or the audio signal supplied from microphone 31 and transmits this through antenna 32 to a base station (not shown). Also, transmitting/receiving device 30 performs prescribed demodulation processing on the received signal received through antenna 32. If an audio signal is present in the signal obtained by this demodulation processing, transmitting/receiving device 30 supplies this audio signal to speaker 33 to produce audio output. On the other hand, if image data or letter data is present in the signal obtained by the demodulation processing, transmitting/receiving device 30 supplies this image data or letter data to system control circuit 40.

Figure 8A:
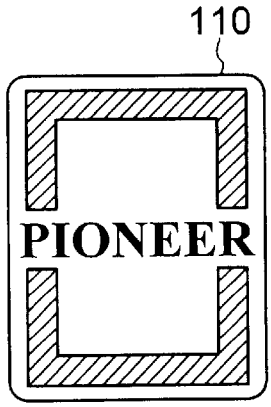
FIG. 8A illustrates an example of a standby image displayed on the display section of the portable terminal shown in FIG. 6.
Figure 8B:
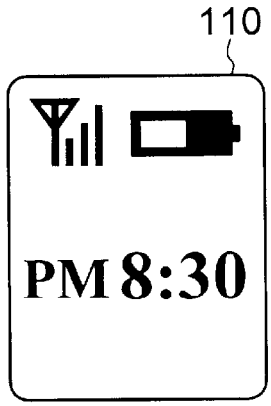
FIG. 8B illustrates an example of a wake-up image displayed on the display section of the portable terminal shown in FIG. 6.

System control circuit 40 converts the image data or letter data supplied from transmitting/receiving device 30 into display data DV to be displayed in display section 110 as shown in FIG. 7 and supplies this to light emission control circuit 12. Also, system control circuit 40 reads the desired image data stored in image data memory 50 and converts this to display data DV to be displayed in display section 110 as shown in FIG. 7 and supplies it to light emission control circuit 12. A plurality of image data providing various types of menu images for selecting control operations of this portable terminal are stored beforehand in image data memory 50. Also, image data for providing a boot image (hereinbelow referred to as "wake-up image") as shown in FIG. 8A, which is temporarily displayed on display section 110 at the time-point of switching on the power source of the portable terminal is stored beforehand in this image data memory 50. In addition, image data for providing a standby image as shown in FIG. 8B which is displayed on display section 110 when awaiting communication of this portable terminal is stored beforehand in this image data memory 50.

As shown in FIG. 7, light-emitting panel 11 comprises n cathode leads (metallic electrodes) $B_1$ to $B_n$ formed corresponding to the horizontal scanning lines in display section 110, m anode leads (transparent electrodes) $A_1$ to $A_m$ formed respectively intersecting with each of these cathode leads, and (n×m) EL elements $E_{1,1}$ to $E_{m,n}$ formed at the intersections of the cathode leads and anode leads. The EL elements $E_{1,1}$ to $E_{m,n}$ that play the role of pixels are arranged in lattice fashion, corresponding to the positions of intersections of anode leads $A_1$ to $A_m$ along the vertical direction and cathode leads $B_1$ to $B_n$ along the horizontal direction, with one terminal thereof being connected to the anode lead (anode lead side of diode constituent E of the above equivalent circuit) and their other terminals (cathode lead side of diode constituent E of the above equivalent circuit) being connected with the cathode leads.

Light emission control circuit 12 respectively controls cathode lead scanning circuit 13 and anode lead driver 14 so as to display on the screen of light-emitting panel 11 an image corresponding to the display data DV supplied from system control circuit 40. Specifically, light emission control circuit 12 supplies to cathode lead scanning circuit 13 scanning pulse signal SP such as to make the respective EL elements $E_{1,1}$ to $E_{m,n}$ capable of being driven, one horizontal scanning line at a time. Furthermore, light emission control circuit 12 generates drive pulses having a logic level corresponding to the display data DV and supplies these drive pulses to anode lead driver 14, one horizontal scanning line ($GP_1$ to $GP_m$) at a time.

Cathode lead scanning circuit 13 comprises scanning switches $\mathbf{5}_1$ to $\mathbf{5}_n$ corresponding to the cathode leads $B_1$ to $B_n$ that individually determine the voltages of the cathode leads. Scanning switches $\mathbf{5}_1$ to $\mathbf{5}_n$ respectively apply earth potential (0 V) to the corresponding cathode lead during the period in which scanning pulse signal SP is supplied from light emission control circuit 12 and in periods other than this apply bias potential Vcc (for example 10 V) thereto. The bias potential Vcc is applied in order to prevent crosstalk light emission by EL elements respectively connected to respective cathode leads to which scanning pulse signal SP is not supplied and is normally set at bias potential $Vcc=V_F$.

Anode power source circuit 10 generates a prescribed anode power source voltage $V_A$ constituting the source of drive current supplied to respective anode leads $A_1$ to $A_m$ in order for anode driver 14 referred to below to drive respective EL elements $E_{1,1}$ to $E_{m,n}$; this is then supplied to anode lead driver 14.

Anode lead driver 14 includes anode drive switches $\mathbf{6}_1$ to $\mathbf{6}_m$ and constant current drivers $\mathbf{2}_1$ to $\mathbf{2}_m$ that supply drive current respectively to the EL elements $E_{1,1}$ to $E_{i,j}$ through anode leads $A_1$ to $A_m$, respectively, of light-emitting panel 11. Constant current drivers $\mathbf{2}_1$ to $\mathbf{2}_m$respectively output prescribed constant currents in accordance with anode power source voltage $V_A$ supplied from anode power source circuit 10 to anode drive switches $\mathbf{6}_1$ to $\mathbf{6}_m$. Anode drive switches 6 apply the output terminal of constant current drivers 2 or earth potential to anode lead A in accordance with the drive pulse GP supplied from light emission control circuit 12. For example, when the drive pulse $GP_1$ that is supplied from light emission control circuit 12 is logic level "1", anode drive switch $\mathbf{6}_1$ connects the output terminal of constant current driver $\mathbf{2}_1$ to anode lead $A_1$ and when drive pulse $GP_1$ is logic level "0" applies earth potential to anode lead $A_1$. Also, when the drive pulse $GP_m$ that is supplied from light emission control circuit 12 is logic level "1", anode drive switch $\mathbf{6}_m$ connects the output terminal of constant current driver $\mathbf{2}_m$ to anode lead $A_m$ and when drive pulse $GP_m$ is logic level "0" applies earth potential to anode lead $A_m$.

The drive current amounts respectively produced by the above constant current drivers $\mathbf{2}_1$ to $\mathbf{2}_m$ are taken as the current amounts necessary to maintain a condition in which the EL elements emit light with the desired instantaneous brightness (hereinbelow, this condition is called the steady light-emission condition). Also, when an EL element is in the steady light emission condition, charge is stored on the capacitative constituent C of this EL element, so the voltage across the two terminals of the EL element is a positive voltage $V_F$ somewhat higher than the light-emitting threshold voltage $V_{th}$ (this voltage is called the forward voltage).

Consequently, only the EL elements on the cathode lead that is set to earth potential in response to the scanning pulse signal SP emit light in response to the drive current that is supplied from constant current drivers 2. At this point, of the respective anode drive switches $\mathbf{6}_1$ to $\mathbf{6}_m$, only the anode switches that are supplied with drive pulses of logic level "1" from light emission control circuit 12 apply drive current on the corresponding anode lead. The respective EL elements $E_{1,1}$ to $E_{i,j}$ that are provided in light-emitting panel 11 are thereby made to assume a light emission condition (light-emitting or non-light-emitting) in response to the display data DV.

Anode voltage detection circuit 150 detects the anode voltage on one prescribed anode lead $A_3$ of the anode leads $A_1$ to $A_m$ and supplies the anode voltage $V_D$ which it thus detects on this anode lead to forward voltage input circuit 151. Anode lead $A_3$ which is the subject of detection of the anode voltage is the anode lead that performs light emission in the high-brightness section in the wake-up image as shown in FIG. 8A displayed on the display section 110 of the portable terminal at the time-point when the power source is turned on. In the wake-up image and shown in FIG. 8A, the alphabetic letters of the "PIONEER" logo are displayed with high brightness. Specifically, one of the anode leads to which there is connected at least one EL element that performs light emission display of the above letters of the alphabet, of EL elements $E_{1,1}$ to $Ei_{j,}$ is taken as the subject for detection of the anode voltage as described above.

Forward voltage input circuit 151 is in an operable condition only while power source voltage $V_L$ is being supplied through switch 152 and, in this condition, inputs anode voltage value $V_D$ that is supplied from anode voltage detection circuit 150 and supplies this as forward voltage value $V_F$ to anode power source circuit 10. When this power source voltage $V_L$ is not being supplied, forward voltage input circuit 151 is in an inoperable condition and the operation of input of anode voltage value $V_D$ supplied from anode voltage detection circuit 150 is not performed. Switch 152 supplies power source voltage $V_L$ to forward voltage input circuit 151 while power source control signal PW of logic level "1" indicating that the power source is ON is being supplied from system control circuit 40. When power source control signal PW of logic level "0" indicating power source OFF is being supplied from system control circuit 40, switch 152 cuts off supply of power source voltage $V_L$ to forward voltage input circuit 151. Consequently, input of anode voltage value $V_D$ supplied from anode voltage detection circuit 150 by forward voltage input circuit 151 is only performed while power source control signal PW of logic level "1" indicating power source ON is being supplied from system control circuit 40. The forward voltage value $V_F$ is therefore updated by the anode voltage value $V_D$ input as described above in this period. However, when power source control signal PW of logic level "0" indicating power source OFF is being supplied, input of anode voltage value $V_D$ is not performed, so updating of forward voltage value $V_F$ is not carried out.

Anode power source circuit 10 adjusts the anode power source voltage $V_A$ to be supplied to the respective constant current drivers $\mathbf{2}_1$ to $\mathbf{2}_m$ so as to be equal to the voltage value obtained by adding the loss voltage generated in constant current drivers 2 to the forwards voltage value $V_F$. Specifically, anode power source circuit 10 performs adjustment such as to lower the anode power source voltage $V_A$ if the voltage value of the anode power source voltage $V_A$ is higher than the voltage value needed to maintain a steady light emission condition of the EL elements and to raise the anode power source voltage $V_A$ if it is lower than this voltage. By means of such power source voltage adjustment, even if for example the forward voltage $V_F$ changes due to change of temperature of the EL elements or change thereof with time etc, an anode power source voltage can be generated having the optimum voltage value tracking this change.

Next, adjustment control of anode power source voltage $V_A$ performed by system control circuit 40 will be described.

Figure 9:
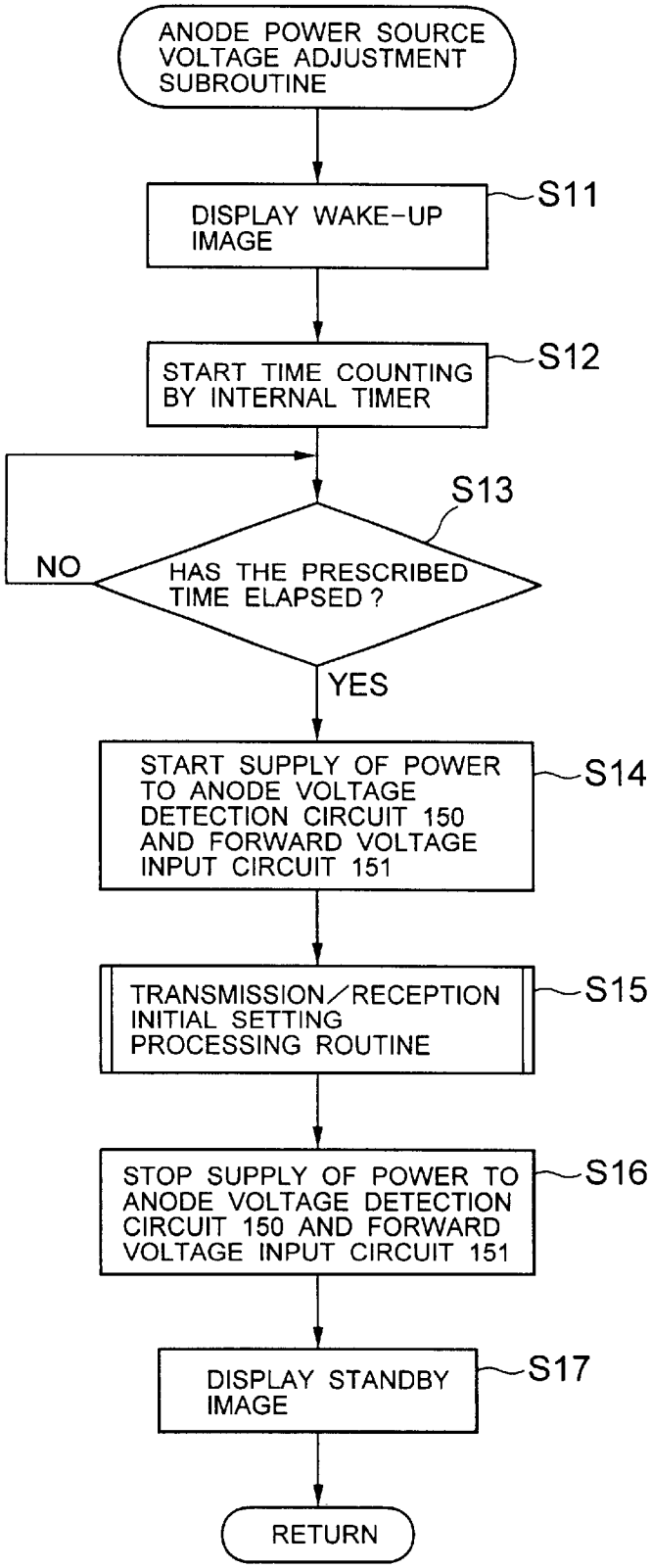
FIG. 9 illustrates a subroutine for executing anode power source voltage adjustment.

When the power source button 21*a* of the portable terminal shown in FIG. 7 is depressed by the user, battery 100 commences supply of power source voltage to the various functional modules with the exception of anode voltage detection circuit 150 and forward voltage input circuit 151. In response to such supply of power, system control circuit 40 first of all executes control in accordance with the subroutine for executing adjustment of anode power source voltage as shown in FIG. 9.

In step 9, first of all, system control circuit 40 reads the image data representing the wake-up image as shown in FIG. 8A from image data memory 50 and supplies display data DV corresponding to this image data to light emission control circuit 12 (step S11). In response to this display data DV, light emission control circuit 12 supplies to cathode lead scanning circuit 13 scanning pulse signal SP such as to drive EL elements $E_{1,1}$ to $Em_{,n,}$ one horizontal scanning line at a time. In addition, light emission control circuit 12 generates drive pulses having a logic level corresponding to this display data DV and supplies these to anode lead driver 14, one horizontal scanning line ($GP_1$ to $GP_m$) at a time. During this period, system control circuit 40 commences (step S12) time counting using an internal timer (not shown) and repeatedly performs (step S13) a determination as to whether or not a prescribed time has passed thereafter, until the prescribed time has elapsed. Specifically, after executing step S11, it waits until the wake-up image is actually displayed as shown in FIG. 8A in display section 110 of the portable terminal. Then, in step S13, when it is determined that the prescribed time has elapsed, system control circuit 40 supplies (step S14) power source control signal PW of logic level "1" indicating power source ON to switch 152. In response to this power source control signal PW of logic level "1", switch 152 commences supply of power source voltage $V_L$ respectively to anode voltage detection circuit 150 and forward voltage input circuit 151. When power source voltage $V_L$ is supplied, forward voltage input circuit 151 inputs the voltage value on anode lead $A_3$ detected by anode voltage detection circuit 150 as forward voltage $V_F$ and supplies this to anode power source circuit 10. When this happens, anode power source circuit 10 adjusts the value of the anode power source voltage $V_A$ that is to be supplied to the respective constant current drivers $\mathbf{2}_1$ to $\mathbf{2}_m$ so as to be equal to a voltage value obtained by adding the loss voltage generated in constant current drivers 2 to the forward voltage value $V_F$. In other words, anode power source circuit 10 performs adjustment such as to lower the anode power source voltage $V_A$ if the voltage value of the anode power source voltage $V_A$ is higher than the voltage value required when the EL elements are maintaining a steady light-emitting condition and such as to raise the anode power source voltage $V_A$ if it is lower than this. By such power source voltage adjustment, even if the forward voltage $V_F$ changes due to the temperature change or change with time of the EL elements, an anode power source voltage can be generated having an optimum voltage value tracking such changes.

After executing step S14, system control circuit 40 shifts (step S15) to execution of the transmission/reception initial setting processing routine, in which initial setting is performed of the various communication operations in respect of transmission/receiving device 30.

After execution of this transmission/reception initial setting processing routine, system control circuit 40 supplies (step S16) a power source control signal PW of logic level "0" indicating power source OFF to switch 152. In response to this power source control signal PW of logic level "0", supply of power source voltage $V_L$ respectively to switch 152, anode voltage detection circuit 150 and forward voltage input circuit 151 is stopped. When supply of power source voltage $V_L$ is stopped, forward voltage input circuit 151 stops the input operation of anode voltage value $V_D$ detected by anode voltage detection circuit 150.

As shown in FIG. 8B, system control circuit 40 reads from image data memory 50 the image data that provides the standby image, and supplies display data DV corresponding to this image data to light emission control circuit 12 (step S17). In response to this display data DV, light emission control circuit 12 supplies to cathode lead scanning circuit 13 a scanning pulse signal SP such that the respective EL elements $E_{1,1}$ to $E_{m,n}$ are driven, one horizontal scanning line at a time. Light emission control circuit 12 generates a drive pulse having a logic level corresponding to this display data DV and supplies this to anode lead driver 14, one horizontal scanning line ($GP_1$ to $GP_m$) at a time. By means of this operation, the display section 110 of the portable terminal is made to display the standby image as shown in FIG. 8B instead of the wake-up image as shown in FIG. 8A and the portable terminal is put in the communication standby condition. That is, by execution of steps S16 and S17, during the non-display period of the wake-up image, supply of power source voltage $V_L$ to anode voltage detection circuit 150 and forward voltage input circuit 151, respectively, is cut off, thereby restricting the power consumption.

After execution of step S17, system control circuit 40 returns to execution of the main routine (not shown) skipping this anode power source voltage adjustment execution subroutine.

In this way, by the anode power source voltage adjustment execution subroutine described above, first of all, when the power source of the portable terminal is turned on, the boot image (wake-up image) is temporarily displayed as shown in FIG. 8A and, only during this display period, the voltage value on the anode lead $A_3$ is input as the forward voltage value. The value of the anode power source voltage $V_A$ is then adjusted so as to be equal to a voltage value obtained by adding to the forward voltage value the loss voltage generated in constant current drivers 2. By such power source voltage adjustment, even if the forward voltage $V_F$ changes due to the temperature change or change with time of the EL elements, an anode power source voltage can be generated having an optimum voltage value tracking such changes.

In this case, the anode lead $A_3$ that constitutes the subject of detection of the forward voltage is one of the anode leads connected with at least one EL element E that performs the display of the logo "PIONEER" that is displayed with high brightness in the boot image referred to above. Thus, drive current must flow on this anode lead $A_3$ during the period while the boot image is displayed.

In this way, a construction to identify whether or not drive current is flowing on the anode lead that is the subject of detection of the forward voltage is made unnecessary and adjustment of the anode power source voltage can be implemented reliably. Since supply of power source voltage to anode voltage detection circuit 150 and forward voltage input circuit 151 is stopped during the period of non-display of the boot image, power consumption is reduced.

It should be noted that, although, in the above embodiment, it is arranged for anode power source voltage adjustment to be performed by executing an anode power source voltage adjustment execution subroutine as shown in FIG. 9 only on turning ON of the power source of the portable terminal, it could be arranged to execute this periodically.

Furthermore, it could be arranged to execute this anode power source voltage adjustment operation periodically when the portable terminal is in a communication standby condition. In this case, the anode lead that is the subject of the forward voltage detection by the anode voltage detection circuit 150 and forward voltage input circuit 151 may be any one of the anode leads that provide a high-brightness display section in the standby image as shown in FIG. 8B such as for example the antenna mark, remaining battery charge mark, or clock display. The antenna mark indicates the reception sensitivity in transmission/receiving device 30 and the remaining battery charge mark indicates the remaining battery charge of battery 100. In the communications standby condition of the portable terminal, the system control circuit 40 repeatedly executes the anode power source voltage adjustment execution subroutine alternately at prescribed times as shown in FIG. 10.

Figure 10:
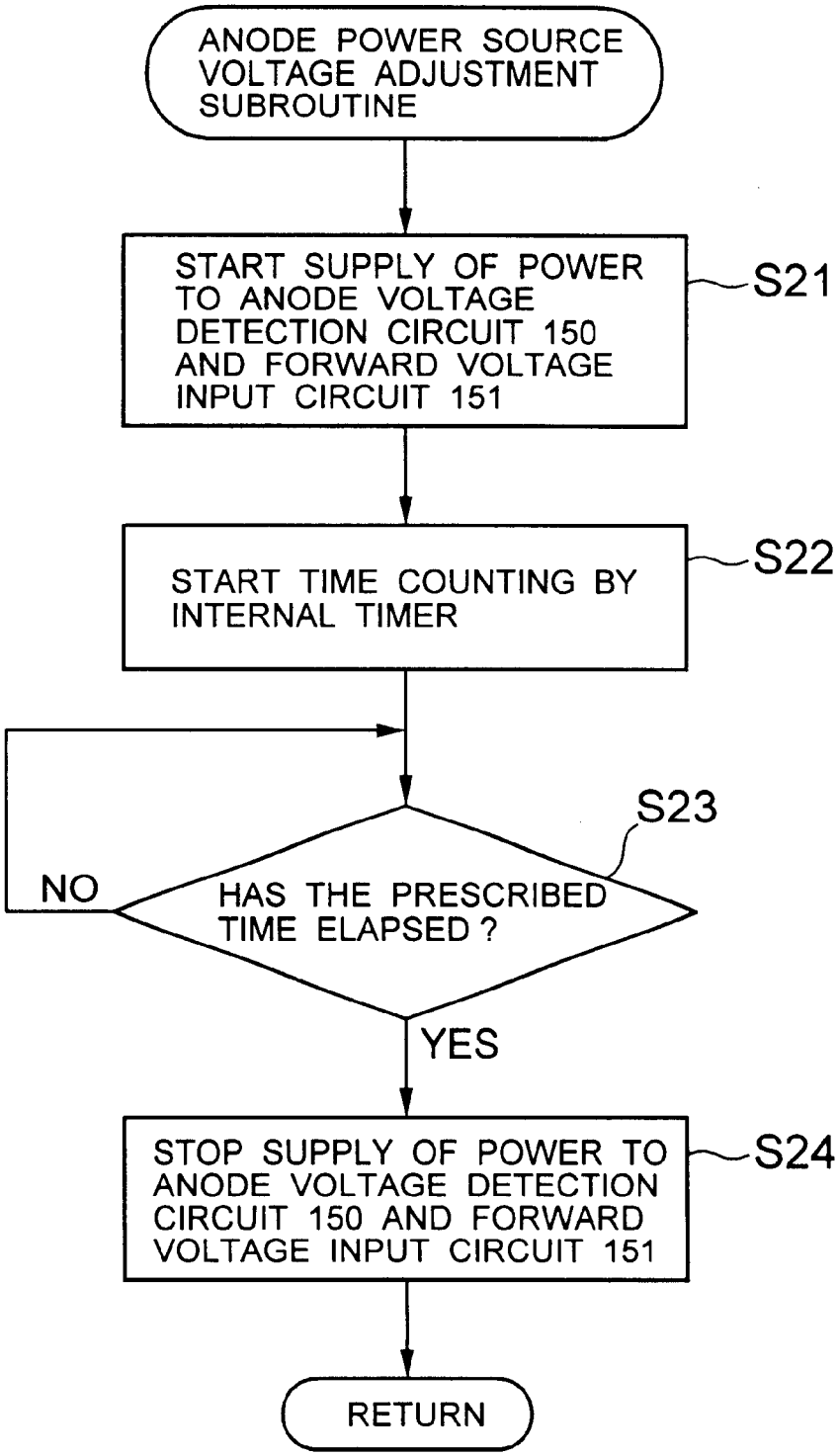
FIG. 10 illustrates another subroutine for executing anode power source voltage adjustment.

In FIG. 10, first of all, system control circuit 40 supplies (step S21) power source control signal PW of logic level "1" indicating power source ON to switch 152. In response to this power source control signal PW of logic level "1", switch 152 commences supply of power source voltage $V_L$ respectively to anode voltage detection circuit 150 and forward voltage input circuit 151. When power source voltage $V_L$ is supplied, forward voltage input circuit 151 commences input of the voltage value on anode lead $A_3$ as forward voltage $V_F$ and supplies this to anode power source circuit 10. Anode lead $A_3$ is one of the anode leads that perform antenna mark display (or remaining battery charge mark display or clock display) in the standby image as shown in FIG. 8B. After executing step S21, system control circuit 40 commences a time count using an internal timer (not shown) (step S22) and after this repeats (step S23) a determination of whether or not to a prescribed time has elapsed, until it is determined that this prescribed time has elapsed. In step S23, when it is determined that the prescribed time has elapsed, system control circuit 40 supplies a power source control signal PW of logic level "0" indicating power source OFF to switch 152 (step S24). In response to this power source control signal PW of logic level "0", switch 152 stops the supply of power source voltage $V_L$ to anode voltage detection circuit 150 and forward voltage input circuit 151, respectively. That is, the adjustment of anode power source voltage by anode power source circuit 10 is performed only in the prescribed time.

After execution of step S24, system control circuit 40 returns to execution of the main routine (not shown) skipping this anode power source voltage adjustment execution subroutine. System control circuit 40 then executes the anode power source voltage adjustment execution subroutine as shown in FIG. 10 at prescribed intervals. In this way, adjustment of anode power source voltage $V_A$ is arranged to be performed periodically during communication standby of the portable terminal. Anode lead $A_3$ that is the subject of detection of forward voltage in this case is one of the anode leads that perform display of a high-brightness section in the standby image shown in FIG. 8B displayed on display section 110 during communication standby i.e., the antenna mark, remaining battery charge mark or clock display.

Consequently, with the anode power source voltage adjustment operation as a described above also, even though a construction for identifying whether or not drive current is flowing on the anode lead that is the subject of forward voltage detection is made unnecessary, adjustment of anode power source voltage can still be executed in a reliable fashion.

It should be noted that, although, in the above embodiment, in detecting the forward voltage on the anode leads, it is arranged for display to be performed as shown in FIG. 8A or FIG. 8B, detection of forward voltage could still be performed in a reliable fashion even without performing such display.

Figure 11:
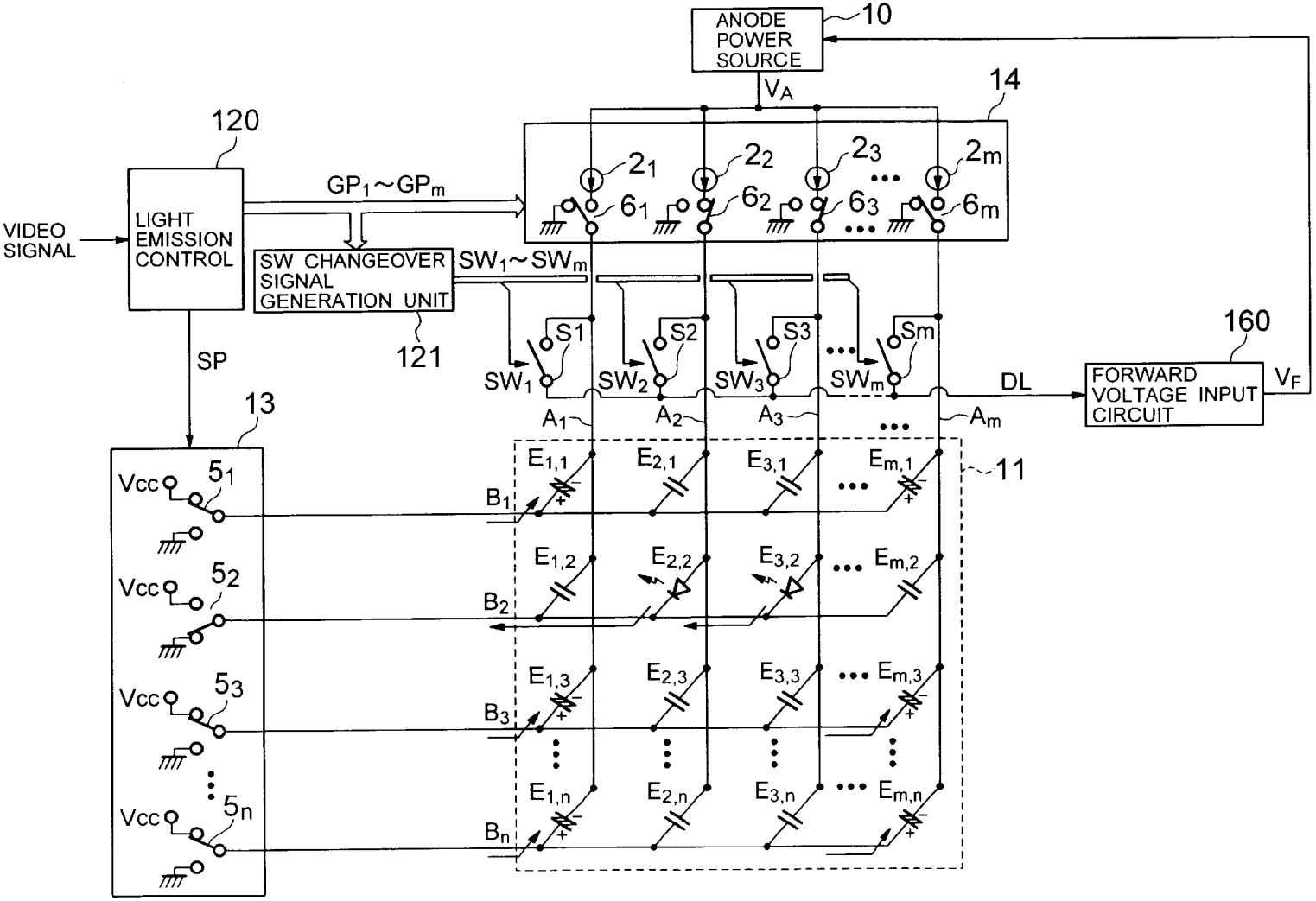
FIG. 11 illustrates a structure of another EL display device according to the present invention.

FIG. 11 is a view showing the construction of an EL display device made in view of such considerations.

As shown in FIG. 11, light-emitting panel 11 includes n cathode leads (metallic electrodes) $B_1$ to $B_n$ formed corresponding to the horizontal scanning lines in a display screen, m anode leads (transparent electrodes) $A_1$ to $A_m$ formed respectively intersecting with each of these cathode leads, and (n×m) EL elements $E_{1,1}$ to $E_{m,n}$ formed at the intersections of the cathode leads and anode leads. The EL elements $E_{1,1}$ to $E_{m,n}$ that play the role of pixels are arranged in lattice fashion, corresponding to the positions of intersections of anode leads $A_1$ to $A_m$ along the vertical direction and cathode leads $B_1$ to $B_n$ along the horizontal direction, with one terminal thereof being connected to the anode lead (anode lead side of diode constituent E of the above equivalent circuit) and their other terminals (cathode lead side of diode constituent E of the above equivalent circuit) being connected with the cathode leads.

In response to an input video signal, light emission control circuit 120 supplies to cathode lead scanning circuit 13 scanning pulse signal SP such as to drive EL elements $E_{1,1}$ to $E_{m,n}$ one horizontal scanning line at a time. In addition, light emission control circuit 120 converts the input video signal to display data corresponding to each pixel and supplies drive pulses corresponding to the logic levels thereof to anode lead driver 14, one horizontal scanning line ($GP_1$ to $GP_m$) at a time. For example, when, of the first row to the m-th row, display data are supplied such as to cause only the first and second row pixels to emit light, drive pulses $GP_1$ and $GP_2$ of respective logic level "1" are supplied to anode lead driver 14 and drive pulses $GP_3$ to $GP_m$ of respective logic level "0" are supplied to anode lead driver 14. That is, in accordance with the input video signal, light emission control section 120 generates drive pulses GP of logic level "1" in respect of pixels that are to emit light and of logic level "1" in respect of pixels that are not to emit light.

Cathode lead scanning circuit 13 includes scanning switches $\mathbf{5}_1$ to $\mathbf{5}_n$ corresponding to cathode leads from $B_1$ to $B_n$ that individually determine the potentials of the cathode leads. Scanning switches $\mathbf{5}_1$ to $\mathbf{5}_n$ respectively apply earth potential (0 V) to the corresponding cathode lead during the period in which scanning pulse signal SP is applied from light emission control circuit 120 and in periods other than this apply bias potential Vcc (for example 10 V) thereto. The bias potential Vcc is applied in order to prevent crosstalk light emission by EL elements respectively connected to respective cathode leads to which scanning pulse signal SP is not supplied and is normally set at bias potential VCC= $V_F$.

Anode power source circuit 10 generates a prescribed anode power source voltage $V_A$ constituting the source of drive current supplied to respective anode leads $A_1$ to $A_m$ in order for anode lead driver 14 referred to below to drive respective EL elements $E_{1,1}$ to $E_{m,n}$; this is supplied to anode lead driver 14.

Anode lead driver 14 includes anode drive switches $\mathbf{6}_1$ to $\mathbf{6}_m$ and constant current drivers $\mathbf{2}_1$ to $\mathbf{2}_m$ constituting current sources that supply drive current respectively to the EL elements $E_{1,1}$ to $E_{i,j}$ through anode leads $A_1$ to $A_m$, respectively, of light-emitting panel 11. Constant current drivers $\mathbf{2}_1$ to $\mathbf{2}_m$ respectively output prescribed constant currents in accordance with anode power source voltage $V_A$ supplied from anode power source circuit 10 to anode drive switches $\mathbf{6}_1$ to $\mathbf{6}_m$. Anode drive switches 6 apply the output terminal of constant current drivers 2 or earth potential to anode leads A in accordance with the drive pulse GP supplied from light emission control circuit 120. For example, when the drive pulse $GP_1$ that is supplied from light emission control circuit 120 is logic level "1", anode drive switch $\mathbf{6}_1$ connects the output terminal of constant current driver 21 to anode lead $A_1$ and when drive pulse $GP_1$ is logic level "0" applies earth potential to anode lead $A_1$. Also, when the drive pulse $GP_m$ that is supplied from light emission control circuit 120 is logic level "1", anode drive switch $\mathbf{6}_m$ connects the output terminal of constant current driver $\mathbf{2}_m$ to anode lead $A_m$ and when drive pulse $GP_m$ is logic level "0" applies earth potential to anode lead $A_m$.

The drive current amounts respectively produced by the above constant current drivers $\mathbf{2}_1$ to $\mathbf{2}_m$ are taken as the current amounts necessary to maintain a condition in which the EL elements emit light with the desired instantaneous brightness (hereinbelow, this condition is called the steady light-emission condition). When an EL element is in the steady light emission condition, charge is stored on the capacitative constituent C of this EL element, so the voltage across the two terminals of the EL element is a positive voltage $V_F$ somewhat higher than the light-emitting threshold voltage $V_{th}$ (this voltage is called the forward voltage).

Consequently, only the EL elements on the cathode lead that is set to earth potential in response to the scanning pulse signal SP emit light in response to the drive current that is supplied from constant current drivers 2. At this point, of the respective anode drive switches $\mathbf{6}_1$ to $\mathbf{6}_m$, only the anode switches that are supplied with drive pulses GP of logic level "1" from light emission control circuit 120 apply drive current on the corresponding anode lead. The respective EL elements $E_{1,1}$ to $E_{m,n}$ that are provided in light-emitting panel 11 are thereby made to assume a light emission condition (light-emitting or non light-emitting) in response to the display data DV.

Switch changeover signal generating circuit 121 converts the drive pulses $GP_1$ to $GP_m$ respectively to switch signals $SW_1$ to $SW_m$ in accordance with the signal conversion table as shown in FIG. 12 and supplies these to anode selection switches $S_1$ to $S_m$, respectively. Specifically, first of all, switch changeover signal generating circuit 121 performs a determination of whether or not drive pulses GP are logic level "1" in the order: $GP_1$ to $GP_m$. Thereupon, first of all, if it is determined that a drive pulse GP is of logic level "1", switch changeover signal generating circuit 121 generates switch signals $SW_1$ to $SW_m$ in which the switch signal SW corresponding to this GP is of logic level "1" but the other switch signals SW are all made of logic level "0". Consequently, as shown in FIG. 12, of the respective switch signals $SW_1$ to $SW_m$, only one switch signal SW is then of logic level "1".

Anode selection switches $S_1$ to $S_m$ are m switching elements whose one end is respectively connected with anode leads $A_1$ to $A_m$ while their other ends are connected in common with voltage detection line DL. The respective anode selection switches $S_1$ to $S_m$ are supplied with the respective switch signals $SW_1$ to $SW_m$ in corresponding fashion. The respective anode selection switches $S_1$ to $S_m$ are in OFF condition while they are being supplied with switch signals SW of logic level "0" and are in ON condition while they are being supplied with switch signals SW of logic level "1". When an anode selection switches S is put in ON condition:, the voltage on anode lead A that is connected to the one end of this anode selection switch S is supplied through voltage detection line DL to the forward voltage input circuit 160.

Specifically, switch changeover signal generating circuit 121 and anode selection switches $S_1$ to $S_m$ extract anode leads A in which drive current is flowing in accordance with the drive pulses $GP_1$ to $GP_m$ and select one only of these. The voltage value on this anode lead is then supplied to forward voltage input circuit 160 through voltage detection line DL.

Forward voltage input circuit 160 inputs the voltage value on the above anode lead supplied through voltage detection line DL as forward voltage value $V_F$, and supplies this to anode power source circuit 10. Anode power source circuit 10 adjusts the value of anode power source voltage $V_A$ so as to be equal to a voltage value obtained by adding the loss voltage generated in constant current driver 2 to this forward voltage value $V_F$.

With the construction as shown in FIG. 11, based on the drive pulses $GP_1$ to $GP_m$, a single anode lead A in which drive current flows is automatically selected from among the respective anode leads $A_1$ to $A_m$ as the anode lead that is to be the subject of detection; thus, detection of the forward voltage can be performed in a reliable fashion. It should be noted that, although, in the construction shown in FIG. 11, anode selection switches $S_1$ to $S_m$ respectively were connected to all of the anode leads $A_1$ to $A_m$, it is not necessary essential that anode selection switches S should be respectively provided for all of the anode leads $A_1$ to $A_m$. For example, it could be arranged to provide respective anode selection switches S only for anode leads corresponding to odd-numbered (or even numbered) anode leads $A_1$ to $A_m$.

Also, although, in the above embodiment, the operation in the case where the present invention is applied to a drive device of the so-called current drive type in which the light-emitting elements are made to emit light by supplying a prescribed drive current thereto, it could be applied in the same way also to a drive device of the voltage drive type. In this case, instead of the anode voltage detection circuit 150 shown in FIG. 6, an anode current detection circuit that detects the current value on anode lead $A_3$ may be employed. Furthermore, instead of the forward voltage input circuit 151 shown in FIG. 6, a drive current input circuit that inputs the current value on anode lead $A_3$ detected by the anode current detection circuit only while power source voltage $V_L$ is being supplied from switch 152 may be employed. Furthermore, instead of constant current drivers $\mathbf{2}_1$ to $\mathbf{2}_m$ shown in FIG. 6, constant voltage drivers may be employed. With a voltage drive system of this type, the output voltage value and anode power source voltage value $V_A$ of the constant current drivers are adjusted so that the current value that is input by the drive current input circuit is the desired current value. It should be noted that, if adjustment of the anode power source voltage value $V_A$ can be carried out with high precision, it may not be necessary to adjust the output voltage value of the constant voltage drivers.

Also, as shown in FIG. 8A or FIG. 8B, anode voltage detection circuit 150 detects the anode voltage value $V_D$ from one of the anode leads that perform display of a high-brightness section in the image. However, the EL elements $E_{1,1}$ to $E_{m,n}$ respectively are divided into a group of EL elements that emit red light, a group of EL elements that emit green light, and a group of EL elements that emit blue light in each row and in some cases the voltage that is generated on the anode leads corresponding to these groups are different for each color. Accordingly, it may be arranged to detect respectively the voltage values on the three anode leads that respectively perform red, green and blue light-emitting drive in the high-brightness display section in FIG. 8A or FIG. 8B and to detect the highest voltage of these as the anode voltage value $V_D$.

Figure 13:
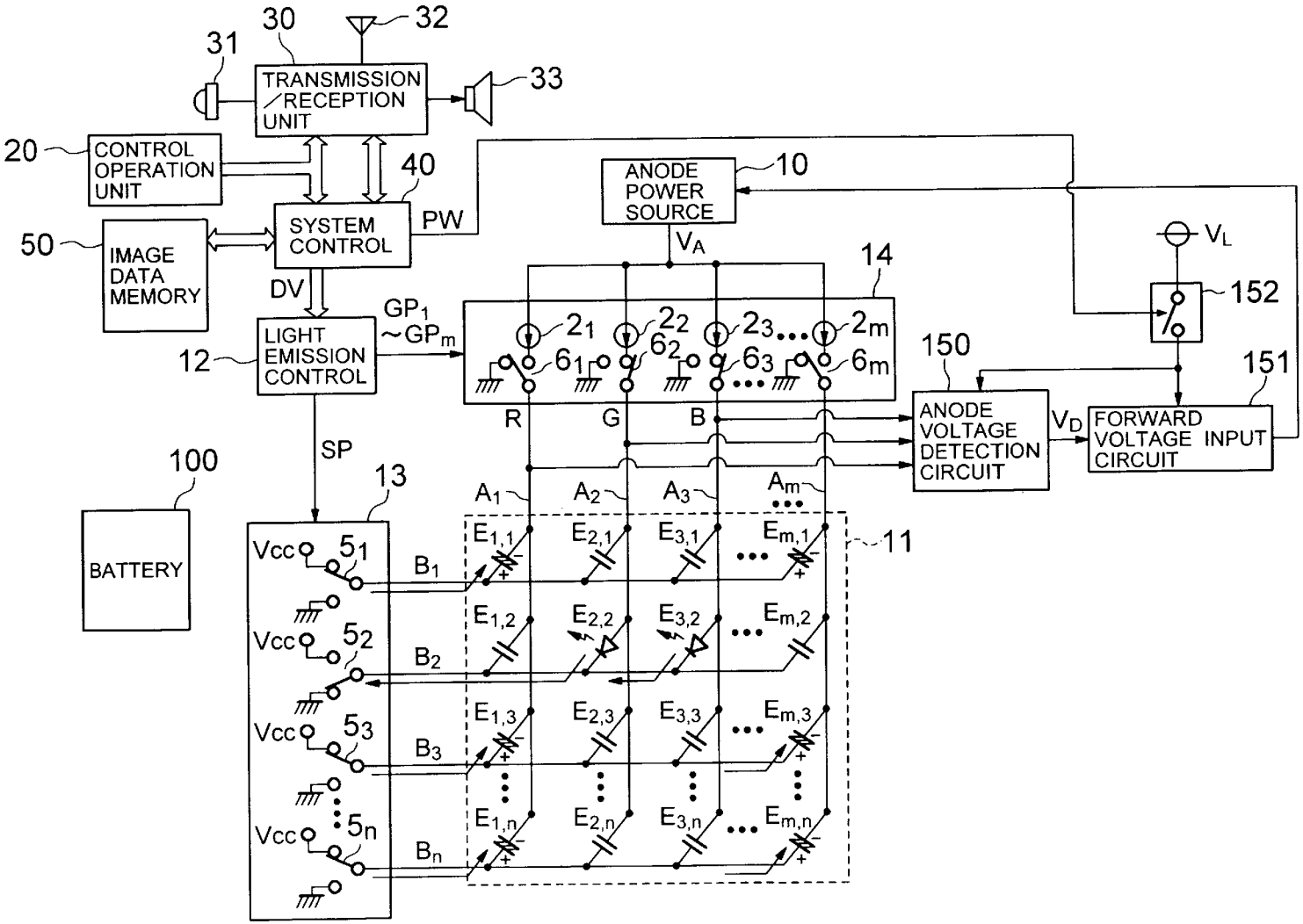
FIG. 13 illustrates the internal construction according to another embodiment of a terminal device on which is mounted an EL display device driven for light emission by a drive device according to the present invention.

FIG. 13 is a view showing the internal construction of a portable terminal on which is mounted an EL display device constructed in view of the above described points.

In FIG. 13, apart from anode voltage detection circuit 150', the remaining construction is the same as that illustrated in FIG. 6, so hereinbelow only the operation of anode voltage detection circuit 150' will be described.

First of all, anode voltage detection circuit 150' respectively detects the voltages on anode lead $A_1$ to which are connected EL elements $E_{1,1}$, $E_{1,2}$, . . . , $E_{1,n}$ that perform emission of red light, on anode lead $A_2$ to which are connected EL elements $E_{2,1}$, $E_{12,2}$ . . . , $E_{2,n}$ that perform emission of green light and on anode lead $A_3$ to which are connected EL elements $E_{3,1}$, $E_{3,2}$, . . . , $E_{3,n}$ that perform emission of blue light. Anode voltage detection circuit 150' supplies to forward voltage input circuit 151 as the anode voltage value $V_D$ the voltage that has the highest voltage value of the voltage on anode lead $A_1$, the voltage on anode lead $A_2$, and the voltage on anode lead $A_3$. Essentially, of the voltages on at least two anode leads to which EL elements of mutually different colors of light emission are respectively connected, the highest voltage value is supplied to forward voltage input circuit 151 as the final anode voltage value $V_D$.

It should be noted that, although in the above embodiment (s), anode power source circuit 10 adjusts the anode power source voltage $V_A$ in accordance with the forward voltage value $V_F$ detected from an anode lead A of light-emitting panel 11, adjustment of the anode power source voltage $V_A$ may not be effected in the case of abnormal values i.e., if the detected forward voltage value $V_F$ exceeds a prescribed range.

This application claims priority of Japanese Patent Application No. 2001-159425, and the entire disclosure thereof is incorporated herein by reference.

What is claimed is:

1. A drive device for a light-emitting panel, the light-emitting panel including a plurality of mutually intersecting anode leads and cathode leads and a plurality of light-emitting elements connected between said anode leads and said cathode leads at the intersections of said anode leads and said cathode leads, in which said respective light-emitting elements in the light-emitting panel are made to selectively emit light in response to information data, the drive device comprising:

an anode power source circuit for generating anode power source voltage;

a current source for generating drive current to cause said light-emitting elements to emit light based on said anode power source voltage;

an anode drive switch for supplying said drive current selectively to said respective anode leads in response to said information data;

an anode voltage detection circuit for designating a prescribed anode lead of said respective anode leads as an anode lead that is the subject of detection and obtaining an anode voltage value by detecting a voltage value on this anode lead designated as the subject of detection;

a control circuit for supplying to said anode drive switch prescribed information data to cause said drive current to be supplied to at least said anode lead designated as the subject of detection; and a forward voltage input circuit for inputting as forward voltage value said anode voltage value only while said prescribed information data is being supplied to said anode drive switch;

wherein said anode power source circuit adjusts said anode power source voltage in response to said forward voltage value that is input by said forward voltage input circuit.

2. The drive device for a light-emitting panel according to claim 1, wherein said control circuit supplies said prescribed information data to said anode drive switch at the time-point when the power source is connected.

3. The drive device for a light-emitting panel according to claim 2, wherein said prescribed information data is image data that provides a boot image that is temporarily displayed on said light-emitting panel at the time-point when said power source is connected.

4. The drive device for a light-emitting panel according to claim 1, wherein said forward voltage input circuit periodically inputs as said forward voltage value said anode voltage value while said prescribed information data is supplied to said anode drive switch.

5. The drive device for a light-emitting panel according to claim 1, wherein said control circuit performs supply of power source voltage to said anode voltage detection circuit and said forward voltage input circuit only while said prescribed information data is supplied to said anode drive switch.

6. The drive device for a light-emitting panel according to claim 1, wherein said anode voltage detection circuit designates said anode lead to which is connected said light-emitting element that emits light with a first color as a first anode lead designated as the subject of detection and designates said anode lead to which is connected said light-emitting element that emits light with a second color different from said first color as a second anode lead designated as the subject of detection and detects the higher of the voltages of the voltage on said first anode lead designated as the subject of detection and the voltage on said second anode lead designated as the subject of detection as said anode voltage value.

7. A portable terminal device comprising a light-emitting panel, the light-emitting panel including a plurality of mutually intersecting anode leads and cathode leads and a plurality of light-emitting elements connected between said anode leads and said cathode leads at the intersections of said anode leads and said cathode leads, said portable terminal device comprising:

a transmitting/receiving circuit that performs transmission and reception of information data;

a battery that generates power source voltage;

an anode power source circuit that generates anode power source voltage using said power source voltage;

a current source that generates drive current to cause said light-emitting elements to emit light based said anode power source voltage;

an anode drive switch that supplies said drive current selectively to said respective anode leads in response to said information data;

an anode voltage detection circuit that designates a prescribed anode lead of said respective anode leads as an anode lead that is the subject of detection and obtains an anode voltage value by detecting a voltage value on this anode lead designated as the subject of detection;

a control circuit that supplies to said anode drive switch prescribed information data to cause said drive current to be supplied to at least said anode lead designated as the subject of detection; and a forward voltage input circuit that inputs as forward voltage value said anode voltage value only while said prescribed information data is being supplied to said anode drive switch;

wherein said anode power source circuit adjusts said anode power source voltage in response to said forward voltage value that is input by said forward voltage input circuit.

8. The portable terminal device according to claim 7, wherein said control circuit supplies said prescribed information data to said anode drive switch at the time-point when the power source is connected.

9. The portable terminal device according to claim 8, wherein said prescribed information data is image data that provides a boot image that is temporarily displayed on said light-emitting panel at the time-point when said power source is connected.

10. The portable terminal device according to claim 7, wherein said prescribed information data is image data that serves as communication standby information including an antenna mark that expresses the reception condition of said transmission/reception circuit, and a battery remaining charge mark that displays the remaining charge of said battery.

11. The portable terminal device according to claim 7, wherein said forward voltage input circuit inputs said anode voltage value as said forward voltage value periodically while said prescribed information data is supplied to said anode drive switch.

12. The portable terminal device according to claim 7, wherein said control circuit effects supply of power source voltage to said anode voltage detection circuit and said forward voltage input circuit only while said prescribed information data is supplied to said anode drive switch.

* * * * *

UNITED STATES PATENT AND TRADEMARK OFFICE

CERTIFICATE OF CORRECTION

PATENT NO. : 6,617,801 B2 
DATED : September 9, 2003
INVENTOR(S) : Shinichi Ishizuka et al.

It is certified that error appears in the above-identified patent and that said Letters Patent is hereby corrected as shown below:

Column 17,
Line 26, delete "light-emitting elements to emit light based said anode." insert
-- light-emitting elements to emit light based on said anode. --

Signed and Sealed this

Ninth Day of December, 2003

JAMES E. ROGAN
*Director of the United States Patent and Trademark Office*